United States Patent [19]

Lakso

[11] Patent Number: 4,711,505

[45] Date of Patent: Dec. 8, 1987

[54] LOCKING SYSTEM

[76] Inventor: Matthew L. Lakso, 19 Bacon St., Westminster, Mass. 01473

[21] Appl. No.: 11,888

[22] Filed: Feb. 6, 1987

[51] Int. Cl.[4] ..... E05C 7/06

[52] U.S. Cl. ..... 312/220; 312/215; 312/221

[58] Field of Search ..... 312/215, 216, 217, 218, 312/220, 221, 222, 107.5

[56] References Cited

U.S. PATENT DOCUMENTS

| | | | |
|---|---|---|---|
| 1,063,844 | 6/1913 | Swanson | 312/221 |
| 1,139,940 | 5/1915 | Westmoreland | 312/221 |
| 3,909,090 | 9/1975 | Breckner et al. | 312/222 |
| 4,272,138 | 6/1981 | Stark | 312/221 |
| 4,298,236 | 11/1981 | Laroche | 312/215 |
| 4,303,287 | 12/1981 | Taplin | 312/215 |
| 4,355,851 | 10/1982 | Slusser | 312/215 |
| 4,429,930 | 2/1984 | Blouin | 312/221 |
| 4,447,098 | 5/1984 | Parker | 312/216 |

*Primary Examiner*—Victor N. Sakran
*Attorney, Agent, or Firm*—Charles R. Fay

[57] ABSTRACT

An interlock system for a filing cabinet or the like preventing any two drawers from being open at one time, the system using a generally vertical line of contacting balls as a lock, and means on each drawer to rigidify the line of balls upon the opening of a single drawer, and returning the line of balls to a loose, unlocked condition upon closing the drawer.

19 Claims, 5 Drawing Figures

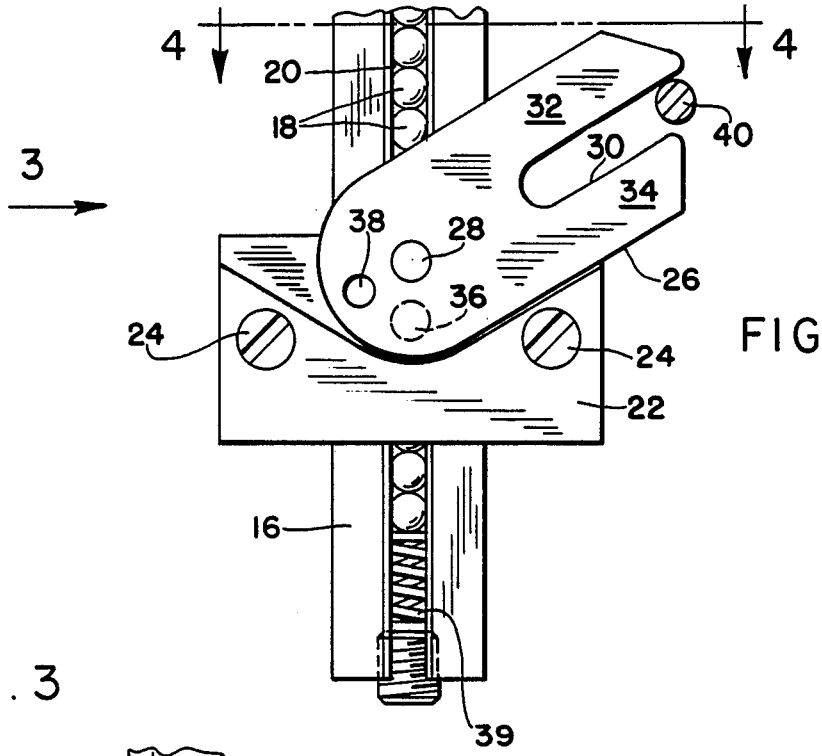
FIG. 2
FIG. 3
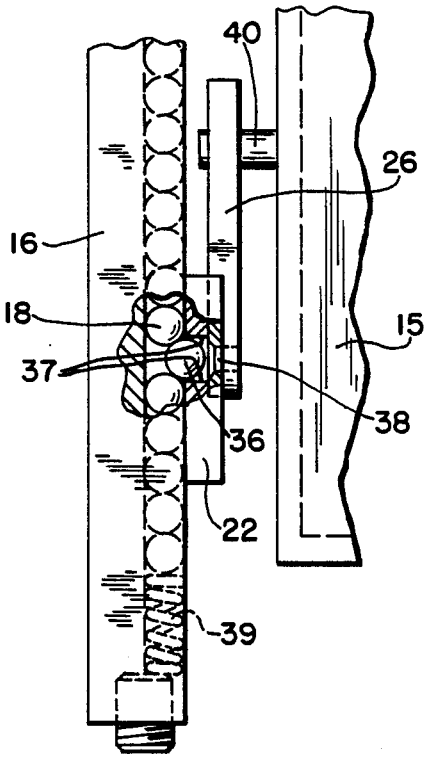
FIG. 5
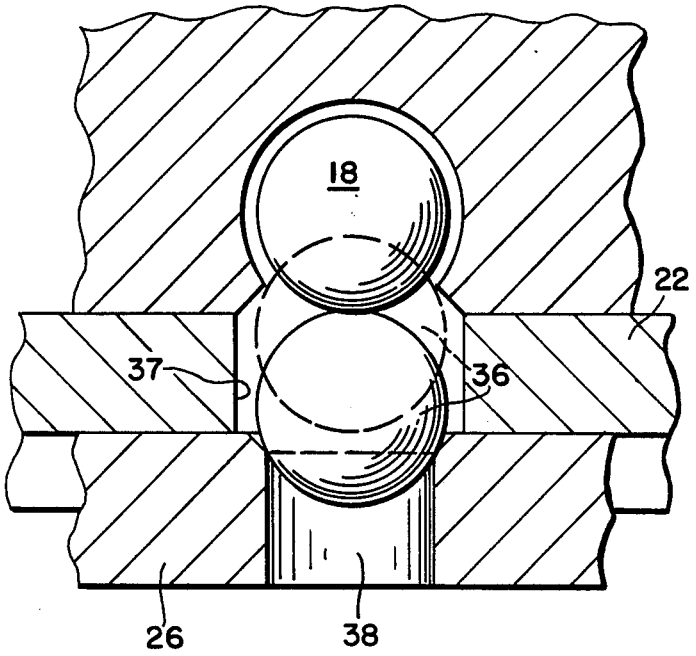

LOCKING SYSTEM

FIELD OF THE INVENTION

Multiple drawer file cabinets having a lock system preventing moving any other drawer to open position when one only of the drawers is already open.

BACKGROUND OF THE INVENTION

Many file cabinets open to such an extent and hold such heavy material as to tend to and actually do tip over forwardly if more than a single drawer is open. This tilting may be injurious to the person and it is very desirable to avoid it. Interlocks have been suggested in the past, see U.S. Pat. Nos. 4,429,930, Feb. 7, 1984; 4,303,287, Dec. 1, 1981; and 4,298,236, Nov. 3, 1981 as examples of this art; but all prior such devices are not completely satisfactory as to operation, cost, and even noise, and an improved interlock device is presented in this case that is easier to install and smoother in operation, more positive in action. Other advantages will become more clear hereinafter.

SUMMARY OF THE INVENTION

In a substantially conventional file cabinet, there is an operating device on each drawer such as a laterally extending fixed pin, and in a fixed position on the casing there is an oscillatable actuator, there being such an actuator for each drawer, each actuator being aligned with its pin. There is a projection on each actuator to engage (and disengage from) a vertical string row or line of balls, e.g., ball bearings, on the casing. The motion of the drawer towards open position swings the actuator which is thereby caused to move its projection from an inoperative position to a position engaged at least partly between a pair of contigous balls, separating the balls and causing the entire string row or line of balls to become tightly interengaged. This in effect converts the row or line of balls from a loose, relaxed condition to a condition wherein the balls are tightly interengaged, in a tense condition that may be referred to as locked.

The pin on the drawer then leaves the actuator as the drawer is more fully opened, and on return to closed position once again impinges on the oscillatable actuator, returning it and its projection to ball-free condition. When the balls are loose, free, or relaxed, any drawer may be opened as above; when the balls are tensed, tight, or locked, no further drawer can be opened, as the locked together balls are sufficient to prevent any further projection from entering the string of balls. Should two or more drawers be attempted to be opened simultaneously, all balls will be locked before even one drawer is opened, so no drawer will open.

BRIEF DESCRIPTION OF THE DRAWINGS

FIG. 2 is a view in elevation showing the locking system per se with a single drawer open;

FIG. 3 is an elevational view partly in section looking in the direction of arrow 3 in FIG. 2;

FIG. 5 is an enlarged diagrammatic view showing the relationship of the locking balls and the actuator ball.

PREFERRED EMBODIMENT OF THE INVENTION

Figure 1:
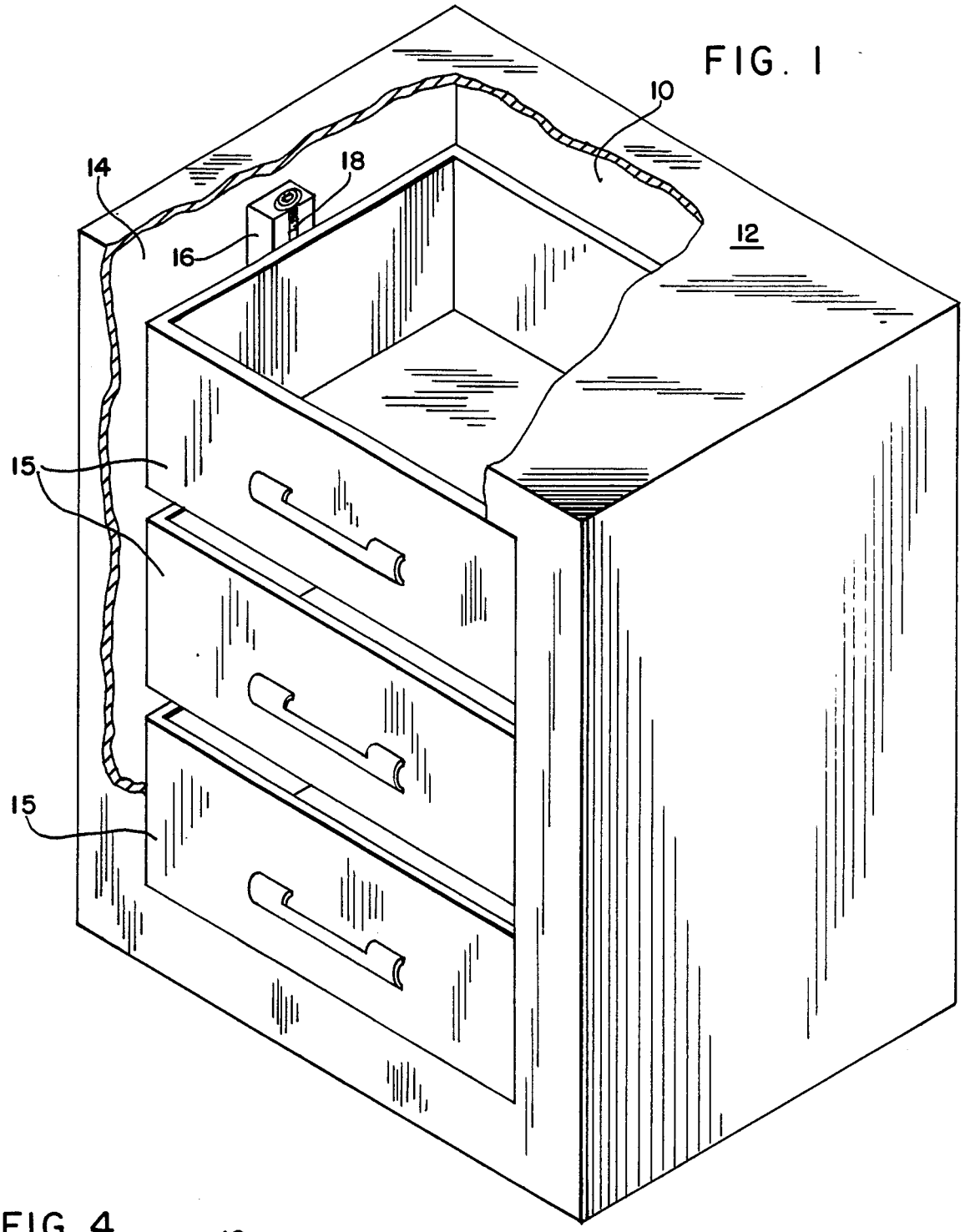
FIG. 1 is perspective view partly cut away showing the general relation of the locking system to an otherwise conventional file cabinet.
Figure 4:
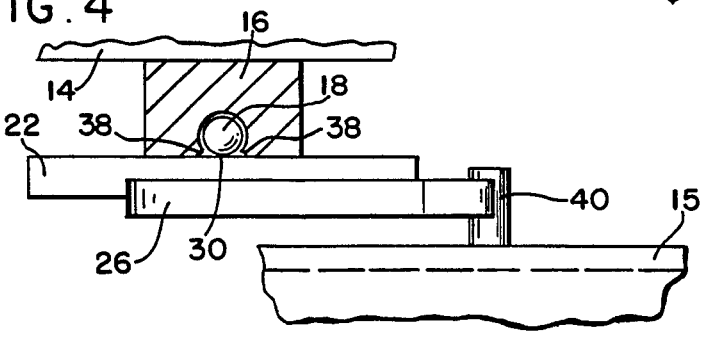
FIG. 4 is a sectional view on line 4—4 of FIG. 2.

A generally conventional filing cabinet is shown in FIG. 1, as having a rear wall 10, top wall 12, and side wall 14, with a series of drawers 15, of which there may be as many as required, but more than one. These drawers comprise a "stack" of drawers, and typically, tend to tip the cabinet forwardly should more than one drawer be pulled to open position. There is of course a support for each drawer comprising telescopically extendable slides, etc., but such structure is all old and well-known and need not be shown, but each drawer can be individually drawn to open position and closed as will be clear without such showing in this case.

A verical receptor, track, or the like 16, is mounted in vertical relation to one or both side walls 14 at the inner aspect thereof, facing the stack of drawers. Each such track contains a string or row or line of balls 18, resting one upon the next below for the extent necessary for the balls to correspond spacially with the number of drawers. the pertinent fact is that these balls do not quite fill the track vertically as will become clear hereinafter. However, the receptor or track 16 is open at the front, by reason of slot 20 which makes the balls 18 accessible from the front, i.e., at the side facing the drawers, but this slot is narrow enough to to restrain the balls, as in their loose condition, to a vertical row or line. The balls 18 are "loose", because they do not quite completely fill the receptor or track, which acts as a tube in which the balls are held.

For each drawer there is a plate 22 appropriately secured to the side wall 14 across the receptor track 16 by any means, such as screws 24, and these plates each provide a swivel mount for an actuator 26, as by means of a pivot pin 28, or the like on the plate. The actuator herein has a radial slot 30 defined by a longer arm 32 and spaced shorter shorter arm 34 tangentially arranged as in FIG. 2. Offset from the axis of the actuator is a ball 36, or similar object, held in a convenient recess 37 in plate 22 and in actuator 26 as at 38, see FIGS. 3 and 5. Thus, with the actuator swung to the right or left, the ball 36 is forced thereby partly into slot 20, see FIG. 5, and impinges upon balls 18 tending to separate them and thus effectively lock the entire string line or row of balls 18 into a fixed, tensed condition. In this situation, no other actuator can be turned sufficiently to cause its ball 36 to move any balls 18, i.e., the tensed, locked balls 18 will not move to accomodate any other ball 36 until such time as the open drawer is closed, and its actuator returns to position releasing the ball 36 so it is ineffective to lock balls 18.

To facilitate this action, the sides of recess 38 are chamfered as shown in FIG. 5, wherein the ball 36 is shown in dotted lines in its inwardmost projection into the line of balls 18, which illustrates the forcing of ball 36 in the line of balls. Ball 36 is forced out of the slot 20 by the actuator 26, to solid line position when the actuator returns to original, upright position.

The receptor track 16 is preferably equipped with a small spring 39 at at least one end to receive the last ball in the line under pressure from ball 36. Spring 39 will close to substantially solid condition, or expand under release of pressure to position the stack of balls 18. Also, another spring can be used at the other end of the line of balls if found to be desirable.

Thus, but a single drawer may be opened at any one time and should two drawers be attempted to be opened together, they will cause interblockage of each other. In the drawings, a simple pin 40 fixed to each drawer at an appropriate spot works the actuator by entry into slot 30 as the drawer closes, pushing the actuator to upright position wherein ball 36 is free of balls 18. When the drawer is fully home, the pin 40 remains in slot 30, at or near the bottom thereof. As the drawer is moved toward open condition, the pin 40 moves the actuator to the right in FIG. 2 for instance, and on out of slot 30, but leaving the actuator substantially fixed in position to once more receive the pin 40 on drawer closing motion, to be returned to upright position.

I claim:

1. An interlocking system comprising a string of single, whole discrete elements, receptor means to confine said elements in said string variously in a seperable and movable condition and in a contiguous and immovable position along said string, a series of at least two actuators at selectably fixed positions along said string, each actuator having an interposing means arranged to be entered by movement of said actuator at least partly between two of said elements when at least some of the elements may thus be moved along said string and both said two elements are positioned to allow such entrance of the interposing means of one said actuator operating to prevent entrance between elements of the interposing means of the other one or more actuators against movement.

2. The system of claim 1 wherein the discrete elements are provided with curved surfaces to positively receive the respective element engaging means on each actuator.

3. The system in claim 2 wherein the discrete elements are balls.

4. The system of claim 3 wherein the balls are round.

5. The system of claim 1 including a cushioning springy means at at least one end of the line of discrete elements.

6. The system of claim 1 including a spring at each end of the line of discrete elements.

7. The system of claim 1 wherein each actuator is oscillatable on a fixed axis by the means on the respective member.

8. The system of claim 7 wherein the means on each actuator to engage the elements is off-set from the axis of its actuator, so that it moves between operative and non-operative positions as the actuator is oscillated by the actuator engaging means on the respective member.

9. An interlocking system comprising a string of discrete elements, receptor means to confine said elements in said string variously in a separable and movable condition and in a contiguous and immovable position along said string, a series of at least two actuators at selectably fixed positions along said string, each actuator having an interposing means arranged to be entered by movement of said actuator at least partly between two of said elements when at least some of the elements may thus be moved along said string and both said two elements are positioned to allow such entrance of the interposing means of one said actuator operating to prevent entrance between elements of the interposing means of the other one or more actuators against movement, the means on each actuator to engage the elements being off-set from the axis of its actuator, so that it moves between operative and non-operative positions as the actuator is oscillated by the actuator engaging means on the respective member, and the discrete element engaging means on each actuator being a ball-like element movable on its actuator transversely to the axis of the row of discrete elements as the actuator is engaged and moved by the respective actuator engaging means on the respective member.

10. The system of claim 9 wherein the actuator engaging means of a member engages the respective actuator at the other side of the axis of the actuator from the discrete element engaging means thereon.

11. The system in claim 9 including a recess in the actuator to receive the respective element.

12. A casing, a series of independent members therein movable between open and closed positions and an interlocking system therefor that prevents moving a closed member toward open position when any other member is in open position, said system comprising a string of one-piece discrete elements arranged generally transversely to the direction if motion of the members, receptor means to confine portions of said elements in said string selectably in movable and immovable when engaged by the opening motion of a selected said member to release the said member to allow it to be opened and to cause an interposing means at least partially to enter into the said string between two of said elements to spread them apart thereby locking some of said elements into said immovable positions thus preventing entrance into the said string of the interposing means of other actuators and movement of said actuators to release and allow opening of corresponding other members.

13. The casing of claim 12 including a spring at at least one end of the string.

14. The casing of claim 12 wherein the elements have rounded surfaces to receive the actuator between two adjacent elements to move the elements apart.

15. The casing of claim 12 wherein the discrete elements are balls.

16. The casing of claim 15 wherein the balls are round.

17. The system of claim 12 wherein the discrete elements are completely free of each other, and each element has its greatest dimension several times less than the height of any member.

18. The system of claim 12 wherein each discrete element is lesser in size to a significant degree than the vertical height of any member.

19. The system of claim 12 wherein the discrete elements are unconnected but contiguous.

* * * * *